US009376242B2

(12) United States Patent
Seline et al.

(10) Patent No.: US 9,376,242 B2
(45) Date of Patent: Jun. 28, 2016

(54) HEAT AND/OR STEAM ACTIVATED VALVE AND METHOD THEREFOR

(71) Applicant: Avery Dennison Corporation, Pasadena, CA (US)

(72) Inventors: David W. Seline, Strongsville, OH (US); Richard L. Sandt, Brunswick, OH (US); Mary Beth Rusin, Olmsted Falls, OH (US); Nicholas Greco, Berea, OH (US)

(73) Assignee: CCL Label, Inc., Framington, MA (US)

( * ) Notice: Subject to any disclaimer, the term of this patent is extended or adjusted under 35 U.S.C. 154(b) by 393 days.

(21) Appl. No.: 13/863,612

(22) Filed: Apr. 16, 2013

(65) Prior Publication Data

US 2013/0228577 A1 Sep. 5, 2013

Related U.S. Application Data

(62) Division of application No. 12/794,038, filed on Jun. 4, 2010, now Pat. No. 8,439,063.

(60) Provisional application No. 61/184,203, filed on Jun. 4, 2009.

(51) Int. Cl.

| | |
|---|---|
| ***F16K 17/38*** | (2006.01) |
| ***B65D 55/00*** | (2006.01) |
| ***B65D 81/34*** | (2006.01) |

(52) U.S. Cl.

CPC ..... *B65D 55/00* (2013.01); *B65D 81/343* (2013.01); *B65D 81/3446* (2013.01);
(Continued)

(58) Field of Classification Search

CPC .. B65D 55/00; B65D 81/343; B65D 81/3446; B65D 2205/00; Y10T 137/1797; Y10T 137/1624; Y10T 137/1963; Y10T 137/1812; Y10T 137/8811

USPC ..... 137/72, 74, 79, 797; 251/11; 383/100, 383/103; 426/118

See application file for complete search history.

(56) References Cited

U.S. PATENT DOCUMENTS

| | | | |
|---|---|---|---|
| 4,834,247 | A | 5/1989 | Oshima et al. |
| 5,325,880 | A | 7/1994 | Johnson et al. |

(Continued)

FOREIGN PATENT DOCUMENTS

| | | |
|---|---|---|
| AU | 2011/08918 | 6/2010 |
| CN | 101084116 | 12/2007 |

(Continued)

OTHER PUBLICATIONS

Translation of Japanese Publication No. JP10-095470, Package for Microwave Oven, Fuji Seal Co. Ltd., Apr. 14, 1998.

(Continued)

*Primary Examiner* — Craig Schneider
*Assistant Examiner* — Minh Le
(74) *Attorney, Agent, or Firm* — McDonald Hopkins LLC

(57) ABSTRACT

A valve (10) is disclosed which is operable to automatically transition from a closed state to an open state in response to heat. The valve (10) includes: a cover (12) having at least one opening (12*a*) therein; at least one adhesive layer (32, 36) for sealing a perimeter of the cover (12) to a wall (22) of a food cooking package (20) on which the valve (10) is positioned; and, a deformable element (14) that shrinks in response to being exposed to heat, the deformable element (14) having a perimeter which is sealed by an adhesive when the valve (10) is in its closed state, wherein shrinking of the deformable element (14) pulls the perimeter of the deformable element (14) away from a site where it is sealed by the adhesive, thereby breaking the seal about the perimeter of the deformable element (14) and transitioning the valve (10) from its closed state to its open state.

5 Claims, 10 Drawing Sheets

(52) U.S. Cl.
CPC ..... *B65D 2205/00* (2013.01); *Y10T 29/49412* (2015.01); *Y10T 137/1624* (2015.04); *Y10T 137/1797* (2015.04); *Y10T 137/1812* (2015.04); *Y10T 137/1963* (2015.04); *Y10T 137/8811* (2015.04)

(56) References Cited

U.S. PATENT DOCUMENTS

| | | | | |
|---|---|---|---|---|
| 5,428,209 | A | 6/1995 | Babu et al. | |
| 5,443,851 | A | 8/1995 | Christie et al. | |
| 5,587,192 | A | 12/1996 | Beizermann | |
| 5,989,608 | A | 11/1999 | Mizuno | |
| 6,131,879 | A | 10/2000 | Kluge et al. | |
| 6,210,724 | B1 | 4/2001 | Clarke et al. | |
| 7,045,190 | B2 | 5/2006 | Inagaki et al. | |
| 7,105,788 | B2 | 9/2006 | Hopkins | |
| 7,128,863 | B2 | 10/2006 | Kim et al. | |
| 7,172,780 | B1 | 2/2007 | Skaife | |
| 7,240,796 | B2 | 7/2007 | Murray | |
| 7,244,223 | B2 | 7/2007 | Hartman et al. | |
| 7,331,715 | B2 * | 2/2008 | Miller et al. | 383/103 |
| 7,381,453 | B2 * | 6/2008 | Okhai | 428/34.1 |
| 7,709,069 | B2 | 5/2010 | Schmal et al. | |
| 7,837,387 | B2 | 11/2010 | Newrones et al. | |
| 8,439,063 | B2 | 5/2013 | Seline et al. | |
| 8,720,729 | B2 * | 5/2014 | Madai et al. | 220/367.1 |
| 8,783,292 | B2 * | 7/2014 | Hoffman et al. | 137/851 |
| 2001/0012530 | A1 | 8/2001 | Hiyoshi | |
| 2002/0195579 | A1 | 12/2002 | Johnson | |
| 2005/0048301 | A1 | 3/2005 | Kim et al. | |
| 2006/0228057 | A1 | 10/2006 | Newrones et al. | |
| 2007/0090109 | A1 * | 4/2007 | Gustavsson | 220/203.27 |
| 2009/0123614 | A1 | 5/2009 | Bernig et al. | |
| 2009/0314773 | A1 | 12/2009 | Kanzaki et al. | |
| 2010/0242407 | A1 | 9/2010 | Binger et al. | |
| 2010/0266732 | A1 | 10/2010 | Thomas et al. | |

FOREIGN PATENT DOCUMENTS

| | | |
|---|---|---|
| EP | 1354817 | 10/2003 |
| EP | 1593478 | 11/2005 |
| EP | 2437987 | 8/2013 |
| FR | 2629060 | 3/1988 |
| JP | 10-095470 | 4/1998 |
| WO | WO2005/025273 | 3/2005 |

OTHER PUBLICATIONS

Translation of European Application No. EP1593478, Process for covering and venting a functional part and sheet arrangement for performing such process, Schreiner Group GmBH Co. KG, Nov. 9, 2005.

International Search Report, PCT/US2010/037407, Aug. 20, 2010.

Response to International Search Report and Written Opinion filed in corresponding International application PCT/US2010/037407 on Oct. 20, 2010.

Australian Patent Examination Report No. 1, Application No. 2010254830, Nov. 27, 2013.

Chinese Office Action, Application No. 2010800345327, Nov. 15, 2013.

International Preliminary Report on Patentability, PCT/US2010/037407, Dec. 6, 2011.

International Preliminary Report on Patentability, PCT/US2010/037407, Dec. 15, 2011.

Patent Abstracts of Japan, Publication No. JP09-227734, Colored Master Batch Composition and Compound for Propylene-Alpha-Olefin Block Copolymer Resin Molded Product, Sumika Color KK, Sep. 2, 1997.

* cited by examiner

HEAT AND/OR STEAM ACTIVATED VALVE AND METHOD THEREFOR

CROSS-REFERENCE TO RELATED APPLICATION

The present application is a division of U.S. Patent Application No. 12/794,038 filed Jun. 4, 2010, which claims the benefit of U.S. Provisional Patent Application No. 61/184,203 filed Jun. 4, 2009, which are incorporated herein by reference in their entireties.

FIELD OF THE INVENTION

The present invention relates to valves. More specifically, the present invention relates to valves adhered to a container to provide a hermetic and/or water resistant seal while allowing the selective release of pressure and/or gas or steam from the interior of the container.

BACKGROUND OF THE INVENTION

The present inventive subject matter relates to the art of heat or steam activated valves particularly in connection with cooking vessels, such as bags, containers, cartons or other like packaging for food or other consumable components. Such cooking bags or other like packaging suitable for practicing embodiments of the present inventive subject matter are commonly used in microwave ovens, conventional ovens and/or other like ovens. Accordingly, embodiments of the present inventive subject matter are selectively designed for such applications. However, it is to be appreciated that aspects of the present inventive subject matter are also equally amenable to other types of applications.

In general, many home cooks and/or other cooks appreciate convenience in the kitchen and elsewhere. Accordingly, cooking bags and other packages that have the capacity to hold food or other components which can be placed directly in an oven or microwave that allow for the food or contents of the container or package to be cooked or otherwise heated directly in the bag or other packaging have been developed. Frequently, these bags or packages are designed and/or capable of going directly from the freezer or refrigerator to the oven such that the food therein is cooked from an initial frozen or refrigerated state, alleviating the user from thawing the food prior to cooking. The need for the user to transfer the food to multiple containers when cooking is thereby eliminated. Likewise, in a heating or warming application, where the food or components may already be prepared, a single package can serve as the vessel for the subsequent treating (i.e. re-warming) of the contents of the package. In an alternative to food applications, other consumable applications that may undergo simply a heating step include sterile towels or implements, and sanitary or other consumer convenience products.

Additionally, the use of cooking bags and/or other like packaging can reduce or eliminate clean-up insomuch as pots, pans and/or other cookware does not come into contact with the food. The use of pots, pans and/or other cookware may be eliminated altogether. In any event, as can be appreciated, cooking bags and/or packaging of this nature can be a considerable convenience to the cook or other user. However, the use of conventional cooking bags and/or other like packaging of this kind can present certain issues.

One such issue is how to handle steam and/or other like gases that can be generated within the bag or packaging during the cooking process. While some steam development can be desirable, at some particular point in the cooking process it is also commonly preferably to allow the steam to escape from the bag or packaging. Excessive steam build-up can produce too much pressure inside the bag or other packaging and lead to an uncontrolled rupturing of the otherwise sealed or closed bag or package. Furthermore, excess steam buildup inside the bag may cook the food in a shorter time, making it difficult for the user to estimate the amount of time to cook a food product or even overcook the food altogether.

Additionally, to achieve the desired cooking result for the food contained inside the bag or package, it may be desired at some point during the cooking process to have the food exposed to a dryer (less humidified) cooking environment. Accordingly, it can be advantageous to release the steam from the interior of the bag or packaging containing the food or components at some pre-determined point or threshold during the cooking or heating process.

One option to address the foregoing issue would be to have the cook manually open, unseal or otherwise vent the bag or package when it is deemed desirable in order to release steam and/or other like gases that can be generated within the package's interior. Of course, this mandates that the cook must monitor the cooking process to determine if and/or when to vent the bag or package. Moreover, to manually vent the bag or package, the user will typically have to remove the bag or package from the oven or otherwise interrupt the cooking process. Additionally, in a manual operation the cook or other user is exposed to the potential risk of being burned by the escaping hot steam.

The convenience of using the cooking or heating bag or other like package can be further enhanced by having a mechanism that vents steam or other like built-up gases from the bag or package automatically at a desirable time during the cooking or heating process. Thus, there is a current need in the marketplace for a new, improved, economical and simple to use automatic venting mechanism for food cooking bags and/or other like packaging that addresses the above referenced problems.

It is to be appreciated that aspects of the present invention are also equally amenable to other like applications.

SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

In accordance with one embodiment, a heat activated valve is adhered to or otherwise provided on a package that contains food or components requiring heat treatment, cooking, or other thermal processing.

In accordance with another embodiment, a food or component cooking or heating package including a heat activated valve is provided.

In accordance with still another embodiment, a valve is disclosed which is operable to automatically transition from a closed state to an open state in response to heat, steam and/or pressure. Suitably, the valve includes: a cover that has at least one opening therein; at least one adhesive layer for sealing a perimeter of the cover to a wall of a food cooking package on which the valve is positioned; and, a deformable element that shrinks in response to being exposed to heat. The deformable element has a perimeter which is sealed by an adhesive when the valve is in its closed state. The shrinking of the deformable element pulls the perimeter of the deformable element away from a site where it is sealed by the adhesive, thereby breaking the seal about at least a portion of the perimeter of the deformable element and transitioning the valve from its closed state to its open state.

In accordance with another exemplary embodiment of the presently described invention, a valve is provided and includes a deformable element that has a top and bottom face, and a perimeter. The deformable element has a shrink range of between about 10% and about 80 and more preferably about 65%. A first pattern of adhesive is applied around the perimeter on the top face of the deformable element. A cover layer is provided that has an opening and a top and bottom face, and a perimeter. A second pattern of adhesive is applied around the perimeter on the bottom face of the cover layer. The perimeter of the cover layer extends beyond the perimeter of the deformable element trapping the deformable element between the cover layer and the package wall. The deformable element is unable to move past the perimeter of the cover layer. The first pattern of adhesive at least temporarily adheres the deformable element to the cover layer and the first pattern of adhesive is disposed inwardly of the second pattern of adhesive.

In a still further exemplary embodiment of the presently described invention a package is described that includes a package having a wall with at least one opening, a heat deformable element that has a top and bottom face and a perimeter. A first pattern of temporary adhesive is applied around the perimeter on the top face of the deformable element. A cover layer is provided that has an opening and a top and bottom face and a perimeter. A second pattern of permanent adhesive is applied around the perimeter of the cover layer on the bottom face of the second layer cover layer so as to adhere the cover layer to the package wall over the at least one opening. The first pattern of adhesive at least temporarily adheres the deformable element to the cover layer. The first pattern of adhesive is disposed inwardly of the second pattern of adhesive.

In a still further exemplary embodiment of the presently described invention a valve is adhered to a package. The package has an interior space and a wall enclosing the interior space, with the wall having at least one opening. A permeable layer of material is applied over the at least one opening in the wall. A deformable element is provided that has a top and bottom face and a perimeter. The deformable material changes from a first condition to a second condition. A frangible pattern of adhesive is applied around the perimeter on the bottom face of the deformable element and the pattern of adhesive adheres the deformable element to the wall. The frangible pattern of adhesive separates from the wall of the package when the deformable element changes from the first position to the second position.

In a still further exemplary embodiment of the presently described invention an intermediate packaging assembly is described that includes a web of material that has a first face and a second face. A plurality of valve assemblies is disposed along the web of material on one of the first and second faces, with each of the valve assemblies having a deformable element with a top and bottom face, and having a perimeter. A first pattern of adhesive is applied around the perimeter on the top face of the deformable element and a cover layer that has an opening and a top and bottom face, and a perimeter. A second pattern of adhesive is applied around the perimeter on the bottom face of the cover layer. The perimeter of the cover layer extends beyond the perimeter of the deformable element. The first pattern of adhesive at least temporarily adheres the deformable element to the cover layer. The first pattern of adhesive is disposed inwardly of the second pattern of adhesive and the second pattern of adhesive temporarily holds each of the valve assemblies to the web of material.

In a still further exemplary embodiment of the presently described invention a method of producing a valve operable to automatically transition from a closed state to an open state in response to heat is described. The initial step of the method includes providing a first web of film in which a cover is to be formed, the cover has a first perimeter encompassing a first region which defines the cover. Next, a second web of heat shrinkable film is provided in which a deformable element is to be formed, the deformable element having a second perimeter encompassing a second region which defines the deformable element. Then at least one opening is formed in the first web of film within the first region and a first adhesive is applied to a first side of the first web of film such that the first adhesive encircles the at least one opening and resides within the first perimeter at a first location adjacent to where the second perimeter will reside upon formation of the deformable element.

Continuing with a discussion of the presently described embodiment, the second web of film is laminated to the first side of the first web of film and the deformable element is formed from the second web of film by separating the deformable element at the second perimeter from a remaining matrix of the second web of film. Next, the matrix of the second web of film is removed from the first side of the first web of film and a second adhesive is applied to a first side of the first web at a second location adjacent to where the first perimeter will reside upon formation of the cover. A third web of material is laminated to the first side of the first web of film and finally, the cover is formed from the first web of film by separating the cover at the first perimeter from a remaining matrix of the first web of film.

Numerous advantages and benefits of the inventive subject matter disclosed herein will become apparent to those of ordinary skill in the art upon reading and understanding the present specification.

BRIEF DESCRIPTION OF THE DRAWINGS

The inventive subject matter disclosed herein may take form in various components and arrangements of components, and in various steps and arrangements of steps. The drawings are only for purposes of illustrating preferred embodiments and are not to be construed as limiting. Further, it is to be appreciated that the drawings may not be to scale.

DETAILED DESCRIPTION OF THE EMBODIMENTS

For clarity and simplicity, the present specification shall refer to structural and/or functional elements, relevant standards and/or protocols, and other components that are commonly known in the art without further detailed explanation as to their configuration or operation except to the extent they have been modified or altered in accordance with and/or to accommodate the preferred embodiment(s) presented herein.

Figure 1:
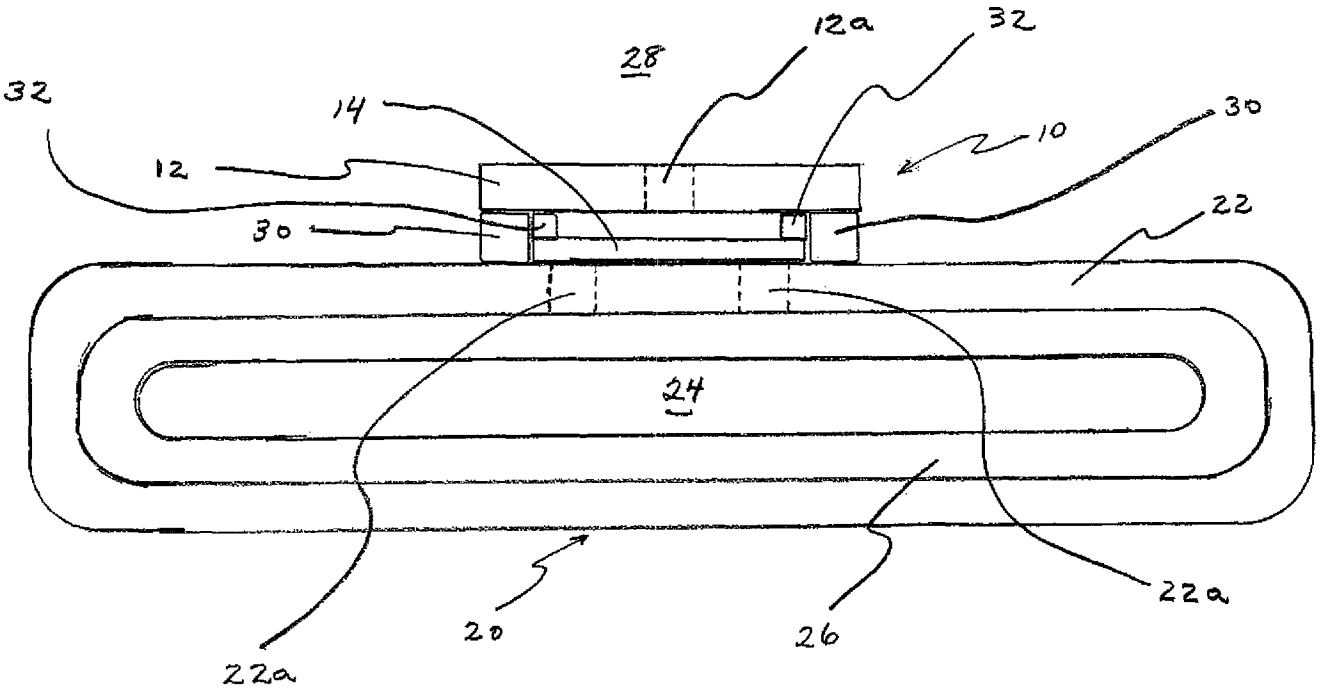
FIG. 1 is a diagrammatic illustration showing a side cross-section view of food cooking package fitted with an exemplary valve in accordance with aspects of the present inventive subject matter.

With reference now to FIG. 1, there is shown a heat, pressure and/or steam activated valve 10 suitable for providing automatic venting of a food cooking bag or other like package 20 on which the valve 10 is arranged or otherwise provisioned. The valve 10 maintains a hermetic/water tight seal. As illustrated, the valve 10 is secured to a wall 22 of the package 20, e.g., by one or more suitable adhesives as will be described later herein. In one suitable embodiment, the package 20 is generally sealed (e.g., hermetically) or otherwise closed with a food item 24 or other components contained therein. In practice, the package wall 22 is able to withstand temperature extremes and/or transitions such as those temperatures experienced within conventional freezers to those typically experienced in accordance with conventional cooking processes (e.g. microwave, stove, oven and the like) without prematurely rupturing or otherwise failing. For example, the package wall 22 may be made from any suitable polymeric film or other material, including but not limited to: polyester, polypropylene, oriented polypropylene, biaxial oriented polypropylene, nylon, polyethylene, etc. The wall 22 may be a flexible package material allowing for the application of the valve 10 to the outer surface of the package wall. In another embodiment, the package material is rigid or substantially rigid. Suitably, the outer surface of the package material or wall 22 is as receptive as possible (e.g., having a high surface energy) to maintain adhesion of the valve 10 to the package 20. In one embodiment of the present invention, the package material resists deformation when subjected to temperatures experienced during its intended use or application, such as manufacturing and storage conditions. Additionally, for food cooking and/or other applications in which the package 20 is intended to contain food or other consumables or components, the package material is suitably approved for direct contact with the food or components contained within the packaging.

At temperatures and/or pressures below a given threshold, the valve 10 is closed, i.e., providing a hermetic and/or water-tight seal to block the passage of materials (e.g., gases, contaminants or liquids) through the valve 10 and into the interior of the packaging.

In one embodiment, when the valve 10 is exposed to an elevated temperature (e.g., temperatures in the range of approximately about 100 to about 400° F. or about 37° C. to about 204° C.) the valve 10 automatically opens to vent an interior 26 of the package 20 to the outside environment 28, e.g., thereby allowing steam and/or other gases to escape from the interior of the package 20 through the valve 10. Of course, it is to be appreciated that the temperature threshold at which the valve 10 transitions from a closed state to an open state is suitably set to coincide with a selected point in a cooking process to which the food 24 and/or package 20 is subjected.

Additionally, the threshold temperature above which opens the valve 10 of the present invention may be dependent upon the article 24 contained within the interior of the package 20. For instance different articles of food or components 24 require different cooking or heating temperatures in order to cook the article of food thoroughly and different articles of food require different cooking processes in turn requiring variable threshold temperatures required to open the valve. Likewise, the moisture content of the article 24 of the package 20 may also have an impact the opening or deformation of the valve element 10.

In one exemplary embodiment, the valve 10 includes an optional cover 12 and a deformable element 14 that deforms in response to experiencing temperature elevation beyond a pre-determined threshold. The cover layer 12 has a perimeter extending beyond the perimeter of the deformable element 14. Suitably, the valve 10 is arranged on the wall 22 of the package 20 so as to cover one or more openings 22*a* such as holes, perforations, slits or other openings 22*a* formed or otherwise existing in the wall 22 of the package. While FIG. 1 shows the valve 10 arranged on an outside surface 22*b* of the wall 22, in practice, the valve 10 may alternately be arranged on an inside surface 22*c* of the wall 22. In either case, as shown in FIG. 1, the cover 12 is suitably a polymeric film which is also provisioned with an opening 22*a* such as one or more holes, perforations, or slits that are formed or otherwise existing therein. Suitable polymeric film and/or other materials from which the cover 12 may optionally be made include but are not limited to, e.g., polyester, polypropylene, oriented polypropylene, biaxial oriented polypropylene, nylon, polyethylene etc. The cover layer 12 may also include a baffle layer (described in connection with FIG. 11) in an alternate embodiment of the present invention.

The cover 12 is able to withstand extreme temperatures as experienced in a conventional cooking apparatus and/or transitions ranging from those typically experienced within conventional freezers to those commonly experienced in accordance with conventional cooking processes without significantly deforming, melting or otherwise failing. Additionally, the cover 12 is suitably durable enough to withstand packaging, shipping and other handling until the point of end use so as to avoid contamination of the contents of the package.

As shown in FIG. 1, the cover has an outer perimeter that extends beyond the perimeter of the deformable element 14, and is bonded and/or otherwise secured to the wall 22 thereby joining the valve 10 to the package 20. Thus, the deformable element 14 is trapped between the wall of the package 22 and the bottom face of the cover layer due to the adhesion of the cover layer 12 to the wall 22 leaving the deformable element 14 in an immovable state. It is worth noting, that the perimeters of the cover layer and the deformable element could be equal or in substantial juxtaposition on one another, offset or splayed from one another or any other suitable arrangement as may be required for the particular packaging or end use. Suitably, where the cover 12 is bonded and/or otherwise secured to the wall 22 a substantial gas and/or liquid tight barrier (e.g., a hermetic seal) is formed between the cover 12 and the wall 22. In the illustrated embodiment, the cover 12 is bonded and/or otherwise secured to the wall 22 by a layer 30 of adhesive that extends around the outer periphery of the cover 12. The opening 22*a* formed in the wall 22 and the opening(s) in the cover layer 12 are located inside the perimeter formed by the layer 30 of adhesive. In another embodiment the adhesive may be applied to the first and second ends of the cover layer 12. The adhesive may also be a form of an epoxy re-adhesive which is a versatile adhesive that can be used to join a valve to a variety of materials. In one embodiment of the present invention, the layer of adhesive 30 of the present invention may be covered with a release liner prior to attachment to a package. In alternate embodiments, the cover 12 may be welded to the wall 22, e.g., via heat or sonic welding. The cover 12 may be otherwise secured to the wall 22 using suitable bonding agents and/or known methods appropriate for the materials from which the cover 12 and/or the wall 22 are made. For example, the cover 12 may be joined to the wall by ultrasonic welding such that the perimeter may remain attached, and the cover 12 deforms backward around the opening as will be discussed herein. Alternatively, the cover 12 may be sealed by a combination of ultrasonic welding and adhesive so as to further control the areas that are intended to break away from the perimeter.

The adhesive layer or bond 30 is able to withstand temperatures at least as high as the threshold temperature that triggers opening of the valve 10 (deformation of material) without the bond between the cover 12 and the wall 22 breaking. Thus, the adhesive used for layer 30 is also able to keep the cover 12 and wall 22 bonded together while being exposed to a range of temperatures including temperatures as low as those commonly experienced in conventional freezers and as high as those commonly experienced in conventional cooking processes. The adhesive used for layer 30 is optionally formulated and/or selected so that the valve 10 will remain joined to the package 20 (i.e., with a substantially gas and/or liquid tight barrier being formed at the location where the cover 12 and wall 22 are bonded together) while the package 20 is exposed to the handling and/or temperature transitions typically experienced in a freezer-direct-to-oven cooking process. Optionally, the adhesive used for layer 30 maintains adhesion to the package material at elevated temperature and is certified for indirect food contact. Application of the adhesive used for layer 30 optionally includes but is not limited to transfer tape and in-line coating. In one embodiment, the layer 30 is a permanent layer of adhesive. Other suitable adhesives for the layer 30 include but are not limited to UV (ultraviolet) curable acrylics, solvent based acrylic adhesives and the like.

The valve 10 opening threshold temperature is optionally in the range of about 100 to about 400° F. (about 37° C. to about 204° C.) but it is worth noting that in other embodiments of the present invention, the threshold temperature may be above 400° F. (about 204° C.) or below 100° F. (about 37° C.). Suitably, a layer 32 of temporary adhesive (e.g., PSA or otherwise) may also be used to create a substantially air and/or liquid tight bond and/or seal around an outer perimeter of the deformable element 14. The deformable element 14 has a top and bottom face. In one embodiment, the layer 32 of temporary adhesive is applied around the perimeter of the top face of the deformable element 14. In a still further embodiment of the present invention, the layer 32 of temporary adhesive is applied to the first and second ends of the deformable element 14 as opposed to the top or bottom face perimeter of the deformable element 14. As shown in FIG. 1, the layer 32 of temporary adhesive forms a substantially air and/or liquid tight bond and/or seal between the outer periphery of the deformable element 14 and the cover 12 such that the holes, perforations, slits or other like openings 12*a* formed in the cover 12 are located inside the perimeter formed by the layer 32 of temporary adhesive.

Alternately, the layer 32 of temporary adhesive forms a substantially air and/or liquid tight bond and/or seal (e.g., a hermetic seal) between the outer periphery of the deformable element 14 and the wall 22 of the package 20. The openings in the wall 22 and the cover layer 12 are located inside the perimeter formed by the layer 32 of temporary adhesive. Layer 30 is disposed inwardly of layer 32. In either case, so long as the adhesive layer 32 (or other bond) remains intact and/or otherwise continues to bond and/or seal the outer periphery of the deformable element 14 to its respective counterpart element (i.e., either the cover 12 or wall 22), the valve 10 remains closed insomuch as gas and/or liquid communication or flow between an interior and exterior of the package 20 via the openings 12*a* and 22*a* is blocked or barred.

Optionally, the adhesive used for layer 32 is applied by a flexographic cylinder, screen print, pattern coated or other method that deposits an adhesive coat weight of approximately 5 GSM to approximately 100 GSM (grams per square meter) in thickness. For food cooking and/or other consumable content applications, the temporary adhesive is suitably certified for indirect food contact and in certain instances where required, the adhesive will be certified for direct food contact. In any event, the adhesion of the temporary adhesive suitably provides enough adhesion to maintain the bond of the deformable element 14 to the cover 12 during processing up until exposure to elevated temperature—at which point, the force or tension created by the pulling, and shrinking caused by the distortion of the deformable element 14 has enough power to overcome the bond of the temporary adhesive, and the deformable element 14 separates from the adhesive. For example, suitable adhesives for the layer 32 include but are not limited to water based emulsions, UV curable adhesives, solvent based, cohesives and the like.

While FIG. 1 illustrates one embodiment in which the deformable element 14, deformable for example by heat, is arranged between the wall 22 and the cover 12 (i.e., the valve 10 is configured such that the deformable element 14 is arranged on the side of the cover 12 which is proximate to the wall 22), in another alternate embodiment (illustrated in FIG. 2), the valve 10 is optionally configured such that the deformable element 14 is arranged on the side of the cover 12 which is distal from the wall 22. As shown, in the alternate embodiment illustrated in FIG. 2, the temporary adhesive layer 32 forms a substantially air and/or liquid tight bond and/or seal between the outer periphery of the deformable element 14 and the cover 12 such that the holes, perforations, slits or other like openings 12*a* formed in the cover 12 are located inside the perimeter formed by the layer 32 of temporary adhesive.

In a further exemplary embodiment, the deformable element 14 is made from a shrinkable film that contracts in response to heat and/or elevated temperatures. Suitably, the shrink film is uni-axially, bi-axially or otherwise oriented so that it contracts along one, two or more directions in response to heat and/or elevated temperatures, thereby opening the valve 10 so as to enable steam and/or other gases and/or liquids to flow through the valve 10 from the package 20. For example, suitable shrink films and/or other like material from with the deformable element 14 may optionally be made and include but are not limited to polyester, polypropylene, polyethylene and/or other like shrink film materials. Optionally, the shrink film from which the deformable element 14 is made exhibits a percentage of shrink greater than approximately 30%.

In operation, when the package 22 and/or attached valve 10 are heated, e.g., in accordance with a conventional cooking process, or subject to energy which causes a rise in the temperature of the material within the package, such as may be encountered during microwave cooking, the deformable element 14 suitably reacts to the heat or elevated temperature in its usual manner. Element 14 attempts to shrink or contract in accordance with its pre-determined shrink response so that the outer periphery of the element 14 pulls away from the layer 32 of temporary adhesive or bond area. Accordingly, when a desired point (i.e., temperature and/or time) is reached in the cooking process, the shrink response of the deformable element 14 overcomes the bonding strength of the temporary adhesive layer 32 thereby breaking the outer periphery of the element 14 free and/or retracting the same away from its previous bonding site. At least a portion of the otherwise substantially air and/or liquid tight bond or seal between the outer periphery of the element 14 and its counterpart element (i.e., either the cover 12 or wall 22) is broken or breached. Accordingly, the valve 10 is effectively opened, i.e., gas and/or liquid communication or flow between an interior and exterior of the package 20 via the openings 12*a* and 22*a* is no longer blocked or barred. See, e.g., FIGS. 3 and 4 (which correspond to the embodiments illustrated in FIGS. 1 and 2, respectively) showing the valve 10 in its open state.

Suitably, the material used for the deformable element 14 and the temporary adhesive layer 32 are selected so that the shrink response of the element 14 and/or the bonding strength of the temporary adhesive cooperate to automatically open the valve 10 when a desired target temperature is reached, e.g., in a cooking process, such that the tension or force created by the shrink causes the seal to break or separate from the bond area. In particular, the adhesive used for the temporary adhesive layer 32 is suitably selected, e.g., to optionally have a bonding strength that weakens or gives way as the target temperature is approached or reached causing the shrink film to deform and exerting force on the bond, and the material used for the element 14 is selected, e.g., to have a shrink response at or near the target temperature which provides sufficient contractive force to overcome the bonding strength of the temporary adhesive at or near the target temperature.

The varying types of shrink film and the respective properties of each, allow different target temperatures and hence performance criteria to be chosen by the user, depending on the particular end use application. The present invention contemplates that the user may choose a valve of the present invention based on the temperature required to break the bond between the adhesive layer 32 and the deformable element 14. For example, one valve of the present invention may have a target temperature in which the bond between the adhesive layer 32 and the deformable element 14 is broken at 200° F. whereas another valve of the present invention may have a target temperature of 400° F.

In one embodiment of the present invention the layer 32 of adhesive may be applied around the perimeter of the bottom face of deformable element. The deformable element 14 remains immovable beyond the perimeter of the cover layer 12 due to the layer 30 that adheres the cover layer 12 to the wall 22. In another embodiment, there are two separate layers of temporary adhesive 32 wherein one layer is applied around the perimeter of the bottom face of the deformable element and around the perimeter of the top face of the deformable element. It is worth acknowledging, that the adhesive of layers 30 and 32 of the present invention may be flood coated.

Conversely, the materials used for the temporary adhesive layer 32 are also selected so that the shrink response of the deformable element 14 and/or the bonding strength of the adhesive are such that the valve 10 remains closed at temperatures sufficiently below the threshold opening temperature. That is to say, at temperatures sufficiently below the threshold temperature, the shrink response of the deformable element 14 and/or the bonding strength of the temporary adhesive used for layer 32 are such that any contractive force exerted by deformable element 14 is not sufficient to overcome or break the bond provided by the temporary adhesive layer 32 at the given temperature.

In one embodiment, when the valve is opening the cover layer 12 "bubbles" up or rises up from the plane of the surface of the package wall 22. In another embodiment, one end or a portion of the cover layer 22 detaches from the package wall.

Even though the present invention mainly addresses an element 14 that deforms in response to heat it is worth noting that the deformable element 14 may deform and shrink in response to other factors such as a decrease in pressure in the interior of the package.

In one embodiment if a cover layer 12 is not provided, a layer of air permeable material may be placed over the opening 22*a* in the wall 22 of the package in order to prevent components within the interior of the package from escaping and undesirable components on the package's exterior from entering the interior of the package, i.e. certain microbial elements, insects etc. The permeable material may be provided underneath the deformable element 14.

Figure 2:
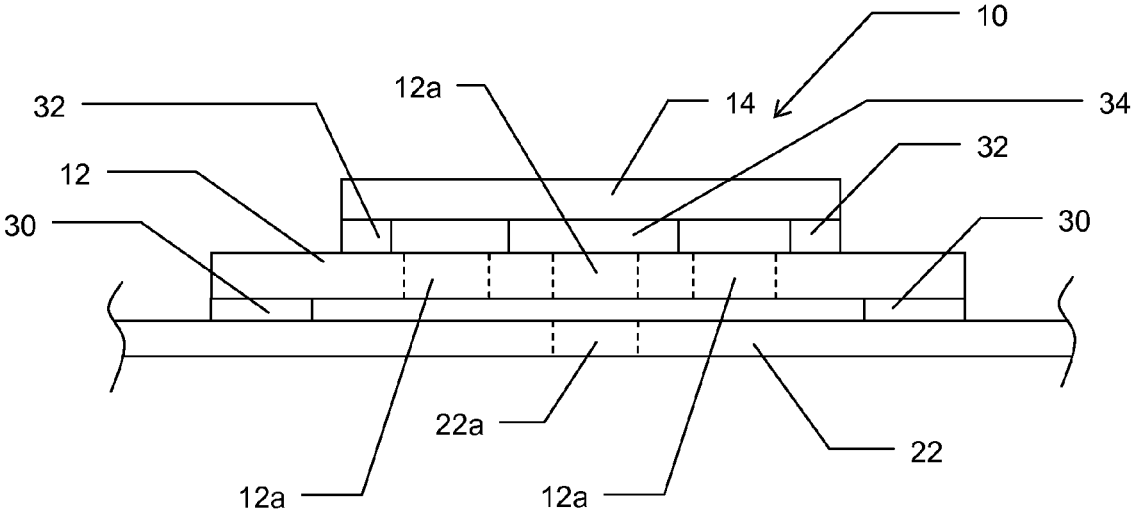
FIG. 2 is a diagrammatic illustration showing a side cross-section of another exemplary valve in accordance with aspects of the present inventive subject matter.
Figure 4:
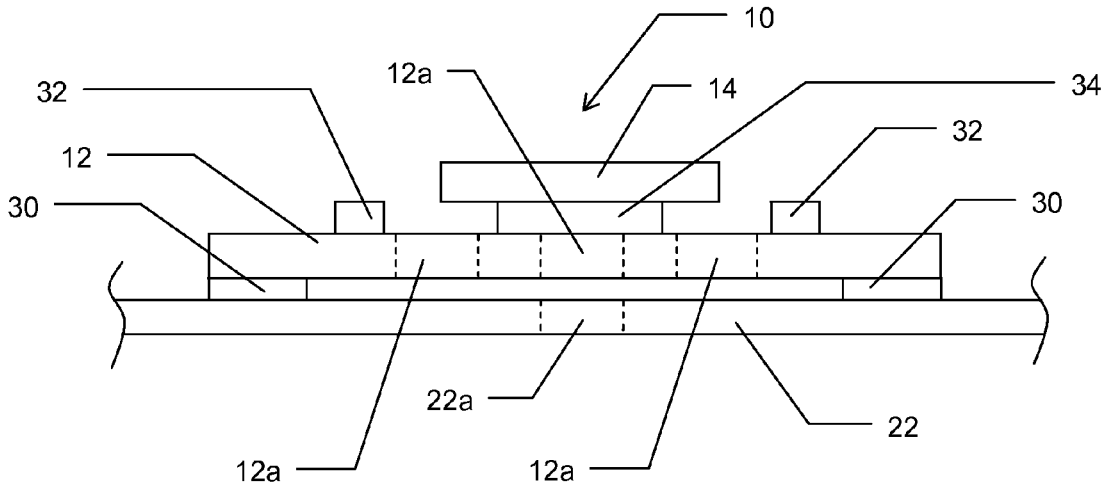
FIG. 4 is a diagrammatic illustration showing a side cross-section view of the valve from FIG. 2 in an open state.

As illustrated in FIGS. 2 and 4, an optional layer 34 of permanent adhesive (e.g., PSA or otherwise) may also used to bond, secure or otherwise hold the deformable element 14 to the cover 12. The same adhesive used for layer 30 may be used for layer 34 or a different adhesive may be used. In operation, when the bond or seal provided by adhesive layer 32 is broken (e.g., as described above), the layer 34 keeps the deformable element 14 attached to the cover 12. The adhesive layer 34 also keeps the deformable element 14 centered or otherwise fixed relative to the cover 12, e.g., to promote a more even and/or consistent breaking of the bond provided by the layer 32 when the deformable element 14 contracts. However, alternately, the layer 34 may be omitted from the embodiment illustrated in FIGS. 2 and 4, e.g., in case it is not desired that the deformable element 14 remain attached once the target temperature has been reached. Accordingly, in this latter alternate embodiment the deformable element 14 is optionally allowed to detach at least partially from the cover 12 when the bond provided by the temporary adhesive layer 32 breaks. In the situation where deformable element 14 "bubbles up", deformable element 14 may remain attached to the package around the periphery and deformable element 14 deforms around a slit, perforation or hole that is provided internally of the periphery to create a wider hole or opening to allow venting of the interior of the package.

Figure 3:
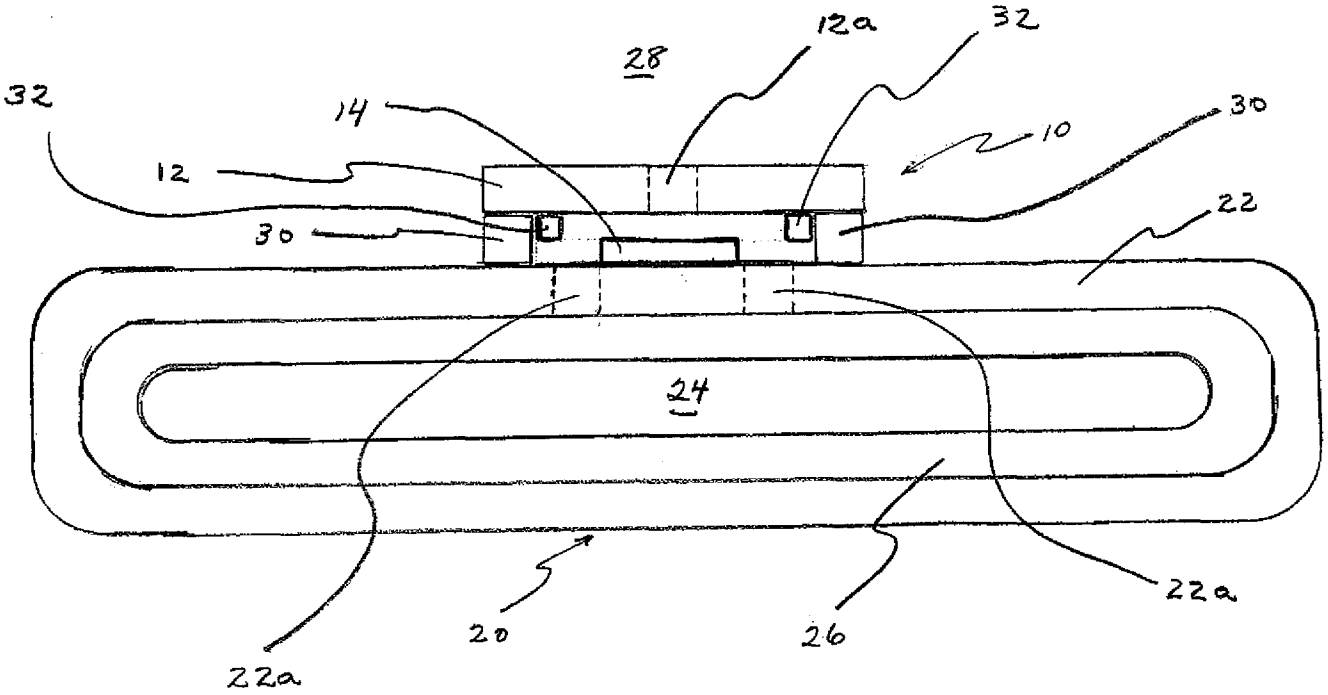
FIG. 3 is a diagrammatic illustration showing a side cross-section view of the valve from FIG. 1 in an open state.

Suitably, as shown in FIGS. 1 and 3, a layer similar to the layer 34 may be omitted insomuch as the deformable element 14 is trapped or otherwise contained between the wall 22 and the cover 12. However, in yet another alternative, a layer similar to the layer 34 may be provided in the embodiment illustrated in FIGS. 1 and 3. For example, a permanent adhesive (such as the adhesive used for layer 30) may optionally be centrally applied to either or both sides of the deformable element 14, thereby optionally bonding, securing or otherwise holding the deformable element 14 to either or both the cover 12 and/or the wall 22.

Figure 5:
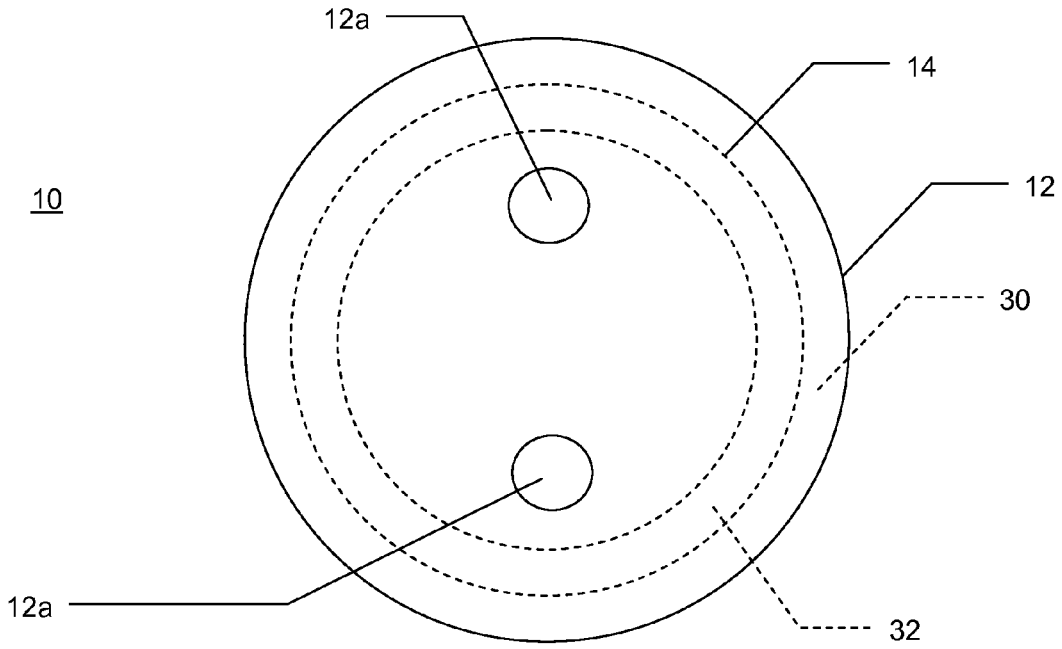
FIG. 5 is a diagrammatic illustration showing a top view of the valve from FIG. 1 with the location of underlying layers and/or elements being defined by dotted/dashed outlines.
Figure 6:
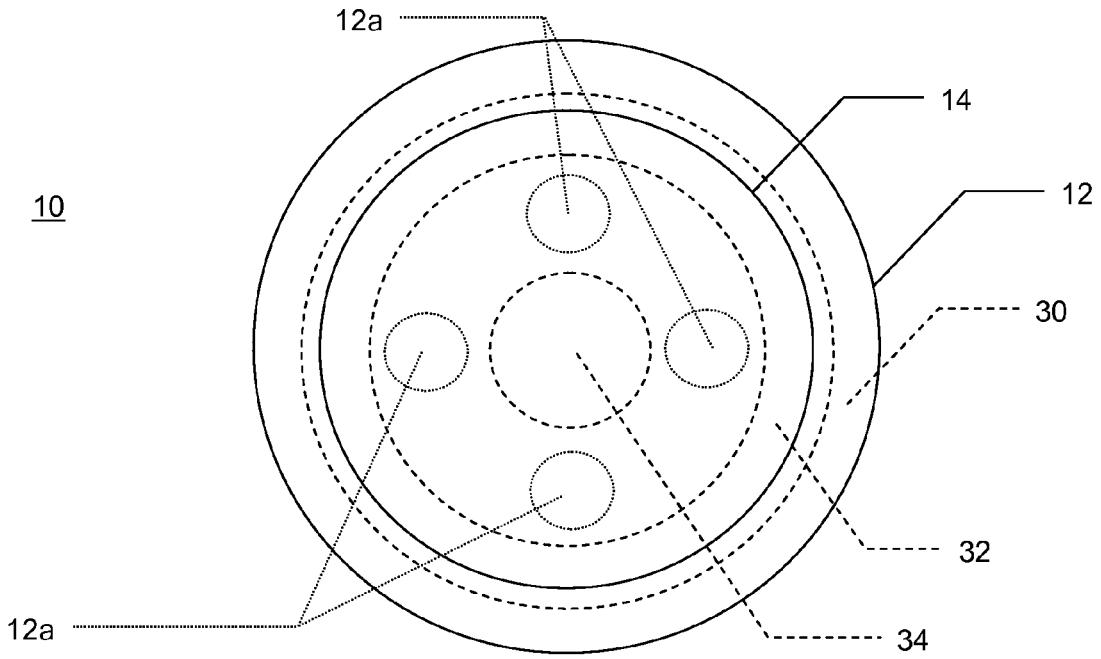
FIG. 6 is a diagrammatic illustration showing a top view of the valve from FIG. 2 with the location of underlying layers and/or elements being defined by dotted/dashed outlines.

As shown, e.g., in FIGS. 5 and 6, the valve 10 optionally has a disk like or generally round shape. That is to say, the cover 12 and the heat deformable element 14 are optionally, substantially circular members that are die cut or otherwise formed from sheets of their respective films or other like constructions. Alternately, however, the valve 10 may take other desired shapes, e.g., square, triangular, oval, rectangular, etc.

Figure 7:
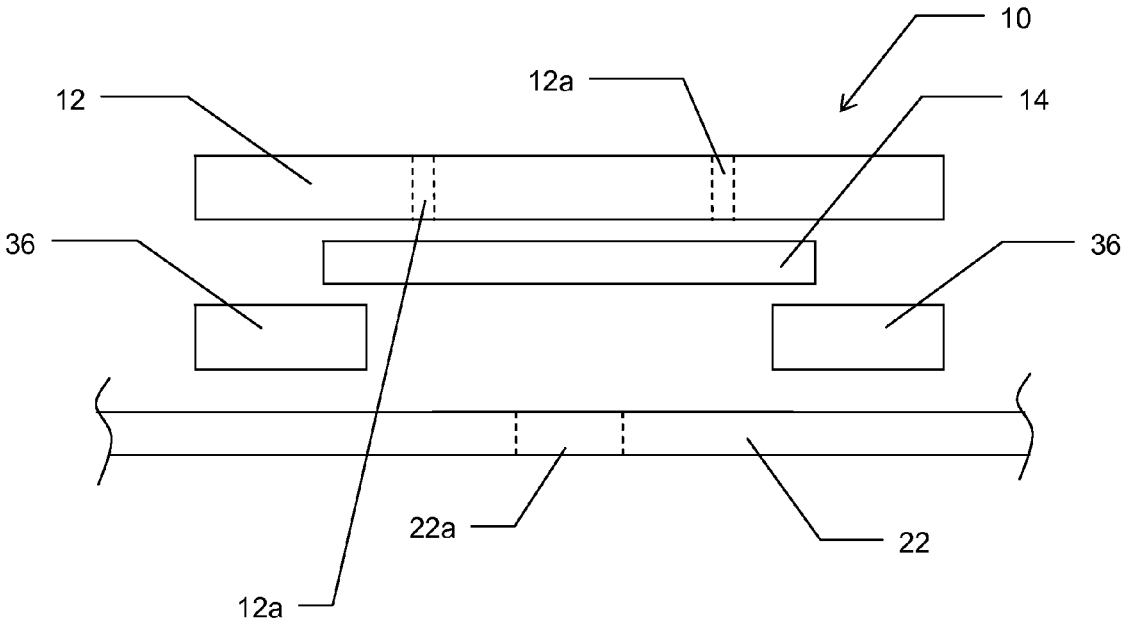
FIG. 7 is a diagrammatic illustration showing a blown apart side cross-section view of yet another exemplary valve in accordance with aspects of the present inventive subject matter.

With reference now to FIG. 7, there is shown yet another embodiment of the valve 10. In this embodiment, a single layer 36 of adhesive (e.g., PSA or otherwise) serves two functions—namely, (i) to permanently affix the valve 10 to the packaging wall 22, and (ii) to temporarily seal the outer periphery of the deformable element 14. More specifically, the adhesive layer 36 suitably creates a substantially permanent bond and/or seal (which is substantially air and/or liquid tight) between the outer periphery of the cover 12 and the packing wall 22. Moreover, the adhesive layer 36 also creates a temporary bond and/or seal (which is substantially air and/or liquid tight) between the outer periphery of the deformable element 14 and the packaging wall 22. When the package 22 and/or attached valve 10 are heated, e.g., in accordance with a conventional cooking process, the deformable element 14 again suitably reacts to the heat or elevated temperature and begins to shrink or deform. That is to say, the deformable element 14 attempts to shrink or contract in accordance with its predetermined shrink response so that the outer periphery of the deformable element 14 pulls away from the layer 36 of adhesive. Accordingly, when a desired point (i.e., temperature and/or time) is reached in the cooking process, the shrink response of the deformable element 14 overcomes the bonding strength of the adhesive layer 36 thereby breaking the outer periphery of the deformable element 14 free and/or retracting the same away from its previous bonding site. In this manner, the otherwise substantially air and/or liquid tight bond or seal between the outer periphery of the deformable element 14 and its counterpart element (i.e., the cover 12 and/or wall 22) is broken or breached. Accordingly, the valve 10 is effectively opened, i.e., gas and/or liquid communication or flow between an interior and exterior of the package 20 via the openings 12*a* and 22*a* is no longer blocked or barred.

Suitably, in the embodiment of FIG. 7, the adhesive used for layer 36 is of such character that the bond and/or seal between the cover 12 and the wall 22 remains intact throughout the entire cooking process, while still allowing the shrink response of the deformable element 14 to shrink or deform at a desired point in the cooking process over come the bond provided by the adhesive layer 36. Accordingly, the adhesive used for layer 36 is able to maintain adhesion to the package material or outer surface of the wall 22 at elevated temperature and is optionally certified for indirect food contact. Suitably, the adhesive is applied by one or more processes, e.g., such as transfer tape, in-line coating and the like. For example, suitable adhesives for the layer 36 include but are not limited to: solvent acrylics, UV curable acrylics, rubber based adhesives, emulsion adhesives and the like.

Figure 8:
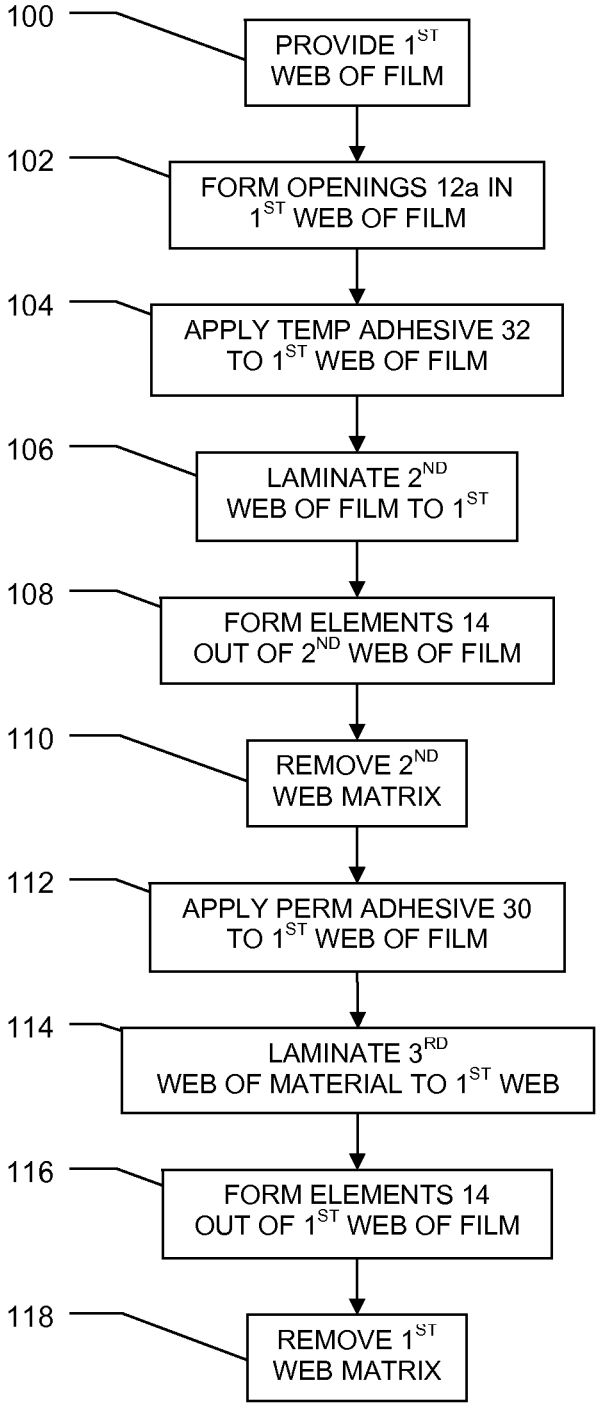
FIG. 8 is a flow chart illustrating an exemplary process for producing valves such as those depicted in FIGS. 1 and 3.

With reference now to FIG. 8, for production purposes, suitably, one or more of the valves 10 can be manufactured at a time and collectively formed or deposited on a release liner from which the valves 10 can be readily removed. Layers of film or other materials used in the construction are optionally laminated or otherwise brought together and selected elements (e.g., such as the cover 12 and deformable element 14) can be die cut from or otherwise formed in the appropriate layer. The adhesive layers are optionally pattern coated or otherwise applied to their appropriate locations in the multilayer construction. In practice, each valve 10 can then be removed from the release liner on an as-desired basis, and applied to the packaging wall 22.

In one suitable embodiment, a plurality of the valves 10 (e.g., as shown in FIGS. 1 and 3) are produced on a web in a continuous format, e.g., in roll form. For example, a first web of film is provided (step 100) which will ultimately become the covers 12. Optionally, the holes, perforations, slits or other like openings 12*a* are then formed (step 102) in the provided web at the designated locations within the periphery of where the covers 12 are to be formed. Suitably, cutting, slitting, punching or the like is employed to form the holes, perforations, slits or other like openings 12*a*. Next, the layer 32 of temporary adhesive is optionally pattern coated or otherwise selectively applied (step 104) to the first web so as to reside at the designated locations within the final formed valves 10.

At this point, a second web of film (e.g., heat shrink film) is laminated to or otherwise brought into contact (step 106) with the surface of the first web that received the layer 32 of temporary adhesive. This second web of film is then optionally die or otherwise cut to form the deformable elements 14 therein (step 108) at the designated locations where they are to appear in the final valve 10 assembly. Suitably, after cutting or otherwise forming the elements 14 in the second web of film, the matrix or remainder of the film surrounding the elements 14 is removed (step 110).

Next, using a window die or pattern coating or other like location selective technique, the permanent adhesive forming layer 30 is applied (step 112) at designated locations to the surface of the first web which has now been exposed by removal of the second web. Of course, the permanent adhesive is selectively applied so as to reside in only those locations where it is intended to appear in the final valve assembly 10.

After application of the permanent adhesive, a third web of material is laminated to or otherwise brought into contact (step 114) with the first web on the same side thereof which received the permanent adhesive and bears the previously formed deformable elements 14. Suitably, this third web acts as a transfer tape or release liner that will bear the finally formed valves 10 so that the valves 10 may be selective removed therefrom and applied to a package (e.g., such as package 20) on an as desired basis. Optionally, the surface of the third web of material facing and/or in contact with the permanent adhesive carried by the first web has a silicone or other release coating or the like thereon which allows the finally formed valves 10 to be readily removed from the third web of material.

At this point, the final valves 10 are formed, e.g., by die or otherwise cutting the covers 12 out of the first web of material at designated locations (step 116). Optionally, after cutting or otherwise forming the covers 14 in the first web of film, the matrix or remainder of the film surrounding the covers 14 is removed (step 118) leaving a plurality of the valves 10 releasably carried on the third web of material, e.g., which may then be rolled-up upon itself.

Suitably, the valve 10 is configured to vent gas, vapor and/or liquids at a controlled or regulated rate desired for different applications. In particular, the one or more holes, perforations, slits or other like openings 12*a* that are formed in the cover 12 are optionally sized, shaped, positioned, numbered and/or otherwise arranged along with the one or more holes, perforations, slits or other like openings 22*a* that are formed in the package wall 22 to achieve a desired flow rate through the valve 10. Furthermore, the diameter of the openings are sized in order to prevent certain components of the outside environment having a diameter larger than the opening into the interior of the package. For example, in some cooking or heating applications, it may be desirable to have steam, vapor or heat rapidly exit the package 20, while in other cooking applications, it may be desirable to have steam, vapor or heat slowly exit the package. Accordingly, the one or more holes, perforations, slits or other like openings 12*a* that are formed in the cover 12 are optionally sized, shaped, positioned, numbered, and/or otherwise arranged to form a baffle which controls or regulates the flow rate through the valve 10. For example, relatively more and/or larger openings 12*a* generally result in a relatively faster flow rate, and conversely, relatively less or smaller openings 12*a* generally result in a relatively slower flow rate.

Figure 11:
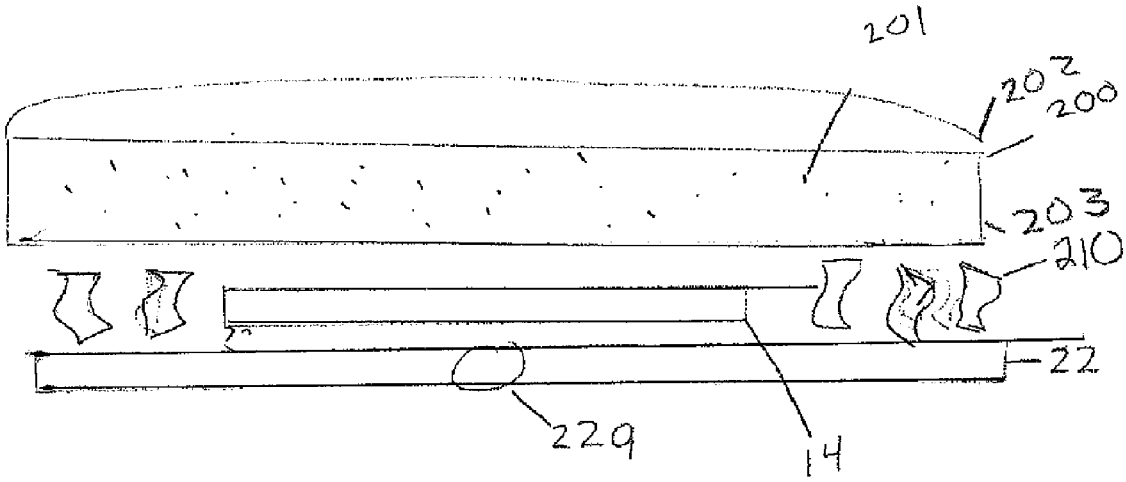
FIG. 11 is a diagrammatic illustration showing a side cross-section view of a valve of the present invention which includes a baffle layer.

In one embodiment of the present invention as illustrated in FIG. 11, the cover layer is a baffle layer 200 comprising a top 202 and bottom 203 face and having a perimeter. The baffle layer 200 has one or more holes, perforations, slits or other like openings 201 in order to achieve a selected flow rate for the application and/or the package 20 to which the valve 10 is applied. A layer of adhesive 210 is provided around the perimeter of the bottom face 203 of the baffle layer 200. A deformable element 14 is provided underneath the baffle layer. A layer of adhesive 32 is provided around the perimeter of the top face of the deformable element 14. The adhesive 32 being disposed inwardly of the layer 30. Alternately and/or in addition, the one or more holes, perforations, slits or other like openings 201 that are formed in the package wall 22 may likewise be arranged to achieve the desired flow rate In one embodiment, a permeable layer (not shown) is provided either underneath the baffle layer 200 or directly above the opening 22*a* in the package wall 22.

In one embodiment, a temporary layer of adhesive is provided over the top face of the baffle layer 200 either flood coated or around the perimeter of the top face 202 of the baffle layer 200. A liner may be applied over the temporary layer of adhesive. The presence of a liner which does not have any openings, prevents components such as gas, water, insects etc from flowing through the baffle layer 200 and opening in the package wall 22 into the package interior, allowing the user to choose when to utilize the valve. The valve may be manually utilized by a user by peeling the release liner from the baffle layer 200 wherein the temporary adhesive layer provided over the baffle layer 200 is removed along with the liner in order to allow the flow of gases out of the interior of the package and/or from the exterior of the package into the interior.

Of course, for the production of the exemplary embodiment shown in FIG. 7, step 104 may optionally be omitted. If step 104 is omitted, a suitable mechanism and/or method such a static-cling or some other suitable temporary holding mechanism and/or method is optionally employed to hold the deformable element 14 in its appropriate place during the production process. Alternately, however, step 104 (i.e., the application of a temporary adhesive) may still be included to temporarily hold the deformable element 14 in its appropriate place during the production process.

Figure 9:
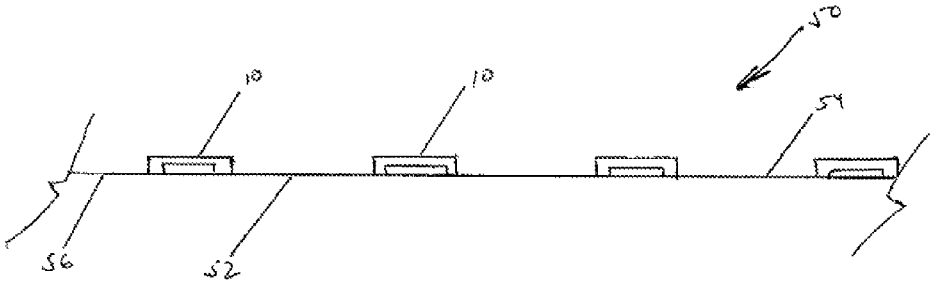
FIG. 9 is a schematic illustration of a web showing a number of intermediate valve assemblies disposed along the web.

In another exemplary embodiment of the present invention an intermediate packaging web 50 is depicted in FIG. 9 in which a plurality of valve assemblies 10 is provided on a web of material 52. The web 52 has a first face 54 and a second face 56 with the valve assemblies 10 provide on the first face 54. The first face 54 of the web 52 is preferably coated with a release material so as to allow each of the valve assemblies 10 to be temporarily adhesively attached and then to be removed upon application to packaging material as will be described herein.

Figure 10:
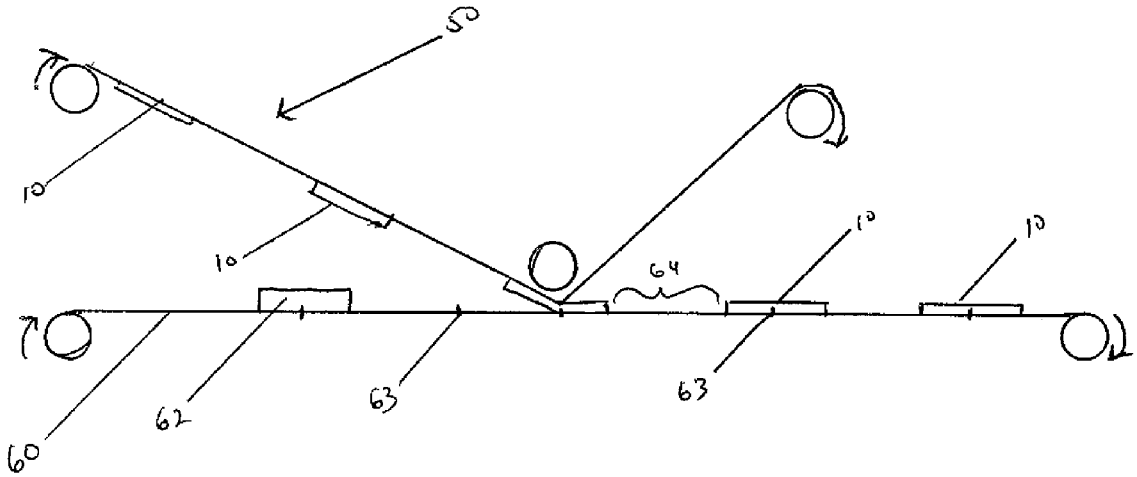
FIG. 10 is a schematic of a process showing the intermediate web of valve assemblies of FIG. 9 being transferred to a web of packaging material.

Reference is now directed to FIG. 10 in which an intermediate packaging film web 60 is created. A plurality of individual valve assemblies 10 may be pre-applied to a web of packaging material 60 in order to provide a more efficient production method where an intermediate packaging material is created. In this embodiment, the individual valve assemblies 10 are first formed such as described in connection with the discussion for FIG. 9, and provided to the packaging film 60 either as a continuous web of assemblies (as shown in FIG. 10), or alternatively as a stack of valve assemblies that can be delivered to the assembly point. The vale assemblies 10 are then taken individually from the web 50 or stack and then may be applied at regularly occurring intervals to packaging material web 60. The spacing 64 of the intervals will be roughly the equivalent of the spacing between individual packages.

The formation of this intermediate packaging material 60 may be produced on traditional packaging equipment that accepts material in roll form such as vertical form fill and seal, horizontal form fill and seal, and thermoform equipment. In this exemplary embodiment as provided in FIG. 10, the packaging material 60 is unwound and during the unwinding of the packaging material a hole, die cut, perforation, score or other opening is placed in the packaging material at punch station 62. The valve 10 is then applied over the opening 63 in the packaging material web 60. The valve 10 may be applied by a label applicator or other application machinery (not shown) or by a web transfer method. Once the valve is applied, the packaging material web 60 having a plurality of valves 10 thereon is then wound back into roll form until such time as the web of packaging material is unwound for forming into individual packages.

In another embodiment of the present invention, the deformable element 14 has an opening allowing for the film to shrink back from the opening in the wall of the package 22. The opening may be a slit, perforation or hole. In one embodiment, the deformable element 14 has an opening and a shrink or deformation range of about 10% to about 80% of its original size in a machine direction, more preferably from about 15% to about 65% and still more preferably about 20% in the machine direction. In one embodiment the deformable element begins shrinking on exposures to about 70° C. and will shrink about 10% of its original size and upon reaching a temperature of 100° C. will shrink about 80% more preferably 65% of its original size or dimension. The deformable element 14 has an opening that can be oriented so that the opening in the deformable element 14 corresponds to the opening in the wall 22.

It is to be appreciated that in connection with the particular exemplary embodiment(s) presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

What is claimed is:

1. An intermediate packaging assembly, comprising;

a web of material having a first face and a second face; and a plurality of valve assemblies disposed along the web of material on one of the first and second faces, each of the valve assemblies having;

a deformable element having a top and bottom face, and having a first perimeter;

a first pattern of adhesive applied around the first perimeter on the top face of the deformable element;

a cover layer having an opening and a top and bottom face, and having a second perimeter;

a second pattern of adhesive applied around the second perimeter on the bottom face of the cover layer;

the second perimeter of the cover layer extending beyond the first perimeter of the deformable element; and the first pattern of adhesive at least temporarily adheres the deformable element to the cover layer and the first pattern of adhesive is disposed inwardly of the second pattern of adhesive and the second pattern of adhesive temporarily holds each of the valve assemblies to the web of material.

2. A valve operable to automatically transition from a closed state to an open state in response to heat, said valve comprising:

a cover having at least one opening therein;

at least one adhesive layer for sealing a perimeter of the cover to a wall of a package on which the valve is positioned; and, a deformable element that shrinks in response to being exposed to heat, the deformable element having a perimeter which is sealed by an adhesive when the valve is in its closed state, wherein shrinking of the deformable element pulls at least a portion of the perimeter of the deformable element away from a site where it is sealed by the adhesive, thereby breaking the seal about the perimeter of the deformable element and transitioning the valve from its closed state to its open state.

3. The valve of claim 2, wherein the cover is a baffle layer.

4. The valve of claim 2, wherein the valve is adhered to the package, the package comprising an interior space and a wall enclosing the interior space, the wall having at least one opening; and wherein the valve is adhered to the package such that the opening of the valve cover is in communication with the at least one opening of the wall of the package.

5. A method of producing a valve operable to automatically transition from a closed state to an open state in response to heat, said method comprising the steps of:

(a) providing a first web of film in which a cover is to be formed, the cover having a first perimeter encompassing a first region which defines the cover;

(b) providing a second web of heat shrinkable film in which a deformable element is to be formed, the deformable element having a second perimeter encompassing a second region which defines the deformable element;

(c) forming at least one opening in the first web of film within the first region;

(d) applying a first adhesive to a first side of the first web of film such that the first adhesive encircles the at least one opening and resides within the first perimeter at a first location adjacent to where the second perimeter will reside upon formation of the deformable element;

(e) laminating the second web of film to the first side of the first web of film;

(f) forming the deformable element from the second web of film by separating the deformable element at the second perimeter from a remaining matrix of the second web of film;

(g) removing the matrix of the second web of film from the first side of the first web of film;

(h) applying a second adhesive to a first side of the first web at a second location adjacent to where the first perimeter will reside upon formation of the cover;

(i) laminating a third web of material to the first side of the first web of film; and, (j) forming the cover from the first web of film by separating the cover at the first perimeter from a remaining matrix of the first web of film.

* * * * *